United States Patent [19]

Jentoft et al.

[11] 4,033,246

[45] July 5, 1977

[54] VENT

[75] Inventors: Arthur P. Jentoft, Kennebunkport; Paul A. Couture, Emery Mills, both of Maine

[73] Assignee: Wasco Products, Inc., Sanford, Maine

[22] Filed: Feb. 9, 1976

[21] Appl. No.: 656,131

[52] U.S. Cl. ..... 98/42 R; 98/43 R

[51] Int. Cl.[2] ..... F24F 7/00; F24F 13/00

[58] Field of Search ..... 98/42 R, 43 A, 43 R, 98/43

[56] References Cited

UNITED STATES PATENTS

| | | | |
|---|---|---|---|
| 1,894,930 | 1/1933 | Hueglin | 98/43 |
| 1,935,216 | 11/1933 | Sievert | 98/43 |
| 1,971,920 | 8/1934 | Ross | 98/43 |
| 2,314,003 | 3/1943 | Mader | 98/43 |
| 2,564,971 | 8/1951 | Harding | 98/43 |
| 2,924,166 | 2/1960 | Gerlitz | 98/43 R |
| 3,951,051 | 4/1976 | Dry | 98/42 R |

*Primary Examiner*—Lloyd L. King

*Attorney, Agent, or Firm*—Wolf, Greenfield & Sacks

[57] ABSTRACT

A system for venting smoke and fumes from selected floors of a multi-story building comprising a vertical smoke pipe or shaft which extends from the basement to the roof of the building and a plurality of vent units disposed along the smoke shaft, one being associated with each floor of the building. Each unit includes a hinged door that opens by gravity force and is normally maintained closed by a latch mechanism that may be operated remotely by electrical or pneumatic means or may be operated manually. A thin metallic gasket seals the door to its frame and further functions as a spring means for urging the door open when the latch mechanism is released.

22 Claims, 5 Drawing Figures

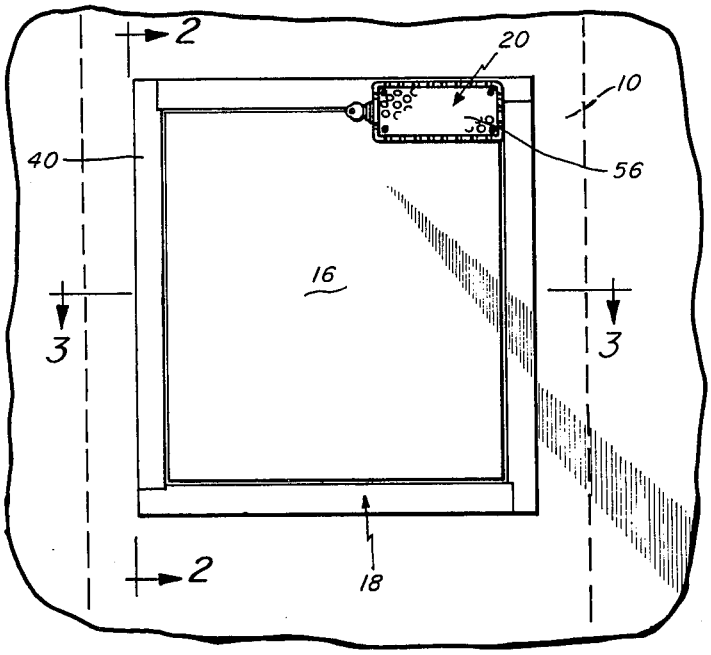
Fig. 1
Fig. 2
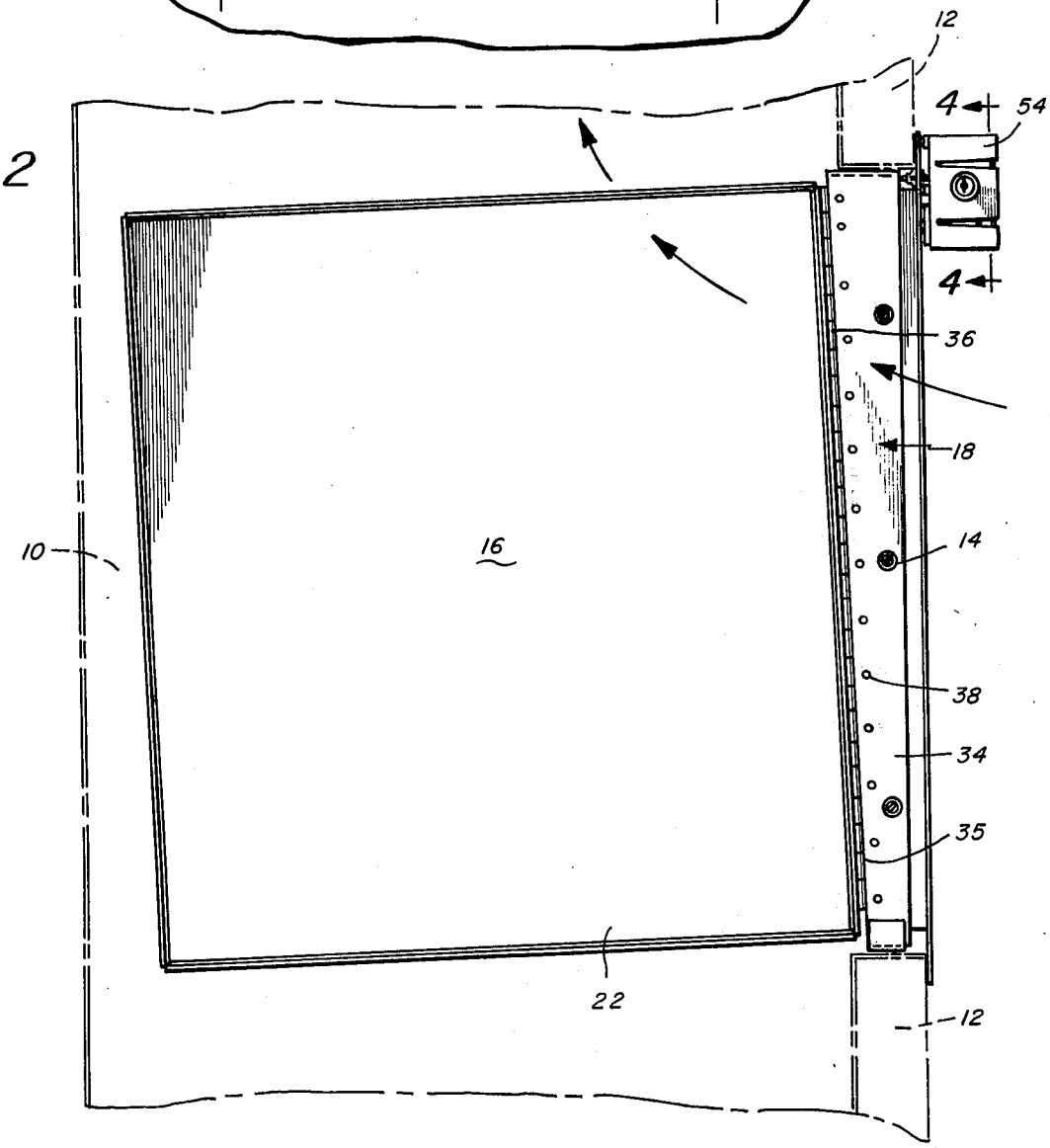

VENT

BACKGROUND OF THE INVENTION

The present invention relates in general to a venting system and venting device and is more particularly concerned with a system for venting smoke from predetermined floors of a preferably multi-story building.

In more recent years the modern buildings that are constructed are of the high-rise type. In these buildings one of the prime concerns is fires and the control thereof. It has been found desirable to confine the fire to the floor where the fire started and further to remove the smoke associated with the fire also. Various types of alarm systems have been devised for reducing the hazard to life of fires in buildings especially where a large number of people are present and where rapid escape from the building is difficult. Generally, the smoke resulting from the fire presents more of a hazard, particularly at the level of the building where the fire is present. While the fire may usually be contained within a single level of the building and eventually extinguished, the hazard to the occupants on the level where the fire is located is significantly increased if the smoke from the fire is allowed to spread throughout that level of the building.

Accordingly, one object of the present invention is to provide a system for venting smoke and fumes from a building. The system of this invention is preferably for use in a multi-story, or high rise building.

Another object of the present invention is to provide a vent system comprising a vertical shaft extending between the basement and roof of the building and a plurality of vent units disposed along the shaft for venting from associated floors of the building.

A further object of the present invention is to provide a vent unit that opens primarily by gravity. The unit is normally maintained in a closed position by a latching mechanism and opens by gravity when the mechanism is released.

Still another object of the present invention is to provide a latch mechanism which is constructed to be heat resistant and can be operated even after the inner surface of the door has been exposed to extreme heat.

Still a further object of the present invention is to provide an improved gasket for the venting unit which reduces leakage to a minimum to thereby insure maximum venting capacity. The gasket, in addition to providing proper sealing, is preferably also heat resistant.

Another object of this invention is to provide a gasket which will serve the additional function of providing an initial opening thrust for the door.

Another object of the present invention is to provide a vent unit having a large mechanism that may be operated either locally or remotely.

SUMMARY OF THE INVENTION

To accomplish the foregoing and other objects of this invention there is provided a vent system preferably for use in a multi-story building for venting smoke, fumes and the like from selected floors of the building. This system comprises a vertical smoke pipe or shaft which extends from the basement to the roof of the building and a plurality of vent units disposed spacedly along the smoke shaft, one being associated with each floor of the building. Each individual vent unit is secured into the smoke shaft and comprises a frame, means for securing the frame in an opening in the shaft, a door, a means for hingedly supporting the door from the frame, with the hinge pin in a tilted position so that the door is permitted to swing open by gravity when unlocked. The door is maintained in a locked position by a latch means including latch parts carried by the door and frame, respectively. The latch parts may comprise a fixed catch secured to the door and a movable member normally biased to engage with the latch but retractable. This movable member may be operated by way of an electrical solenoid or a pneumatic cylinder from a remote location or the movable member may be operated manually. The latch means is preferably contained in a ventilated housing. A metallic gasket is provided intermediate the door and frame and in the disclosed embodiment is spot welded to the frame. This gasket is also constructed to provide some spring action for initially urging the door open when the latch means is released.

BRIEF DESCRIPTION OF THE DRAWINGS

Numerous other objects, features and advantages of the invention will now become apparent upon a reading of the following detailed description taken in conjunction with the accompanying drawings, in which:

FIG. 1 is a front elevational view of a vent unit constructed in accordance with the principles of this invention;

FIG. 2 is a cross sectional view taken along line 2—2 of FIG. 1 with the door of the vent in its open position;

DETAILED DESCRIPTION

Figure 3:
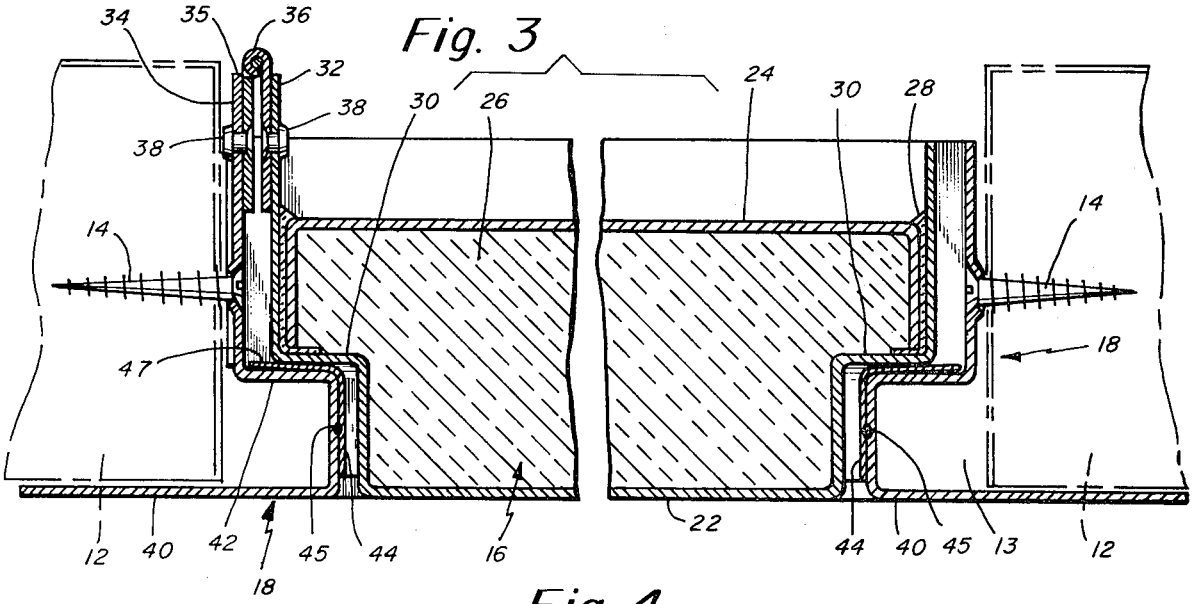
FIG. 3 is a cross sectional view taken along line 3—3 of FIG. 1 with the door in its closed position.

Referring now to the drawings there is shown a vent constructed in accordance with this invention. This unit may be one of a plurality of units each associated with a floor of a multi-story building. A smoke shaft 10 extends vertically from the basement of the building to the roof and there may be a fan or blower disposed at the top of the shaft for drawing the smoke up the shaft from one or more of the opened vent units. The smoke shaft has a front wall 12 which is constructed of a fire resistant or fire retardant material. For example, this wall may be a concrete wall or may be constructed of another approved fire retardant material such as gypsum. The wall 12 defines an opening 13 which may be square or rectangular. This opening receives the vent unit of this invention. FIG. 3 shows screws 14 which are used for securing the unit to the wall 12.

The vent unit generally comprises a door 16, a frame 18 for the door, and a releasable latch mechanism 20 for maintaining the door in a closed position as shown in FIG. 3. The door 16 is of rectangular or square shape and is shown in a cross sectional view in FIG. 3. The door comprises a face piece 22 and U-shaped back piece 24 which together define a space for accommodating an insulating and fire resistant material 26. An asbestos gasket 28 may be provided between the pieces 22 and 24 to serve as a thermal break. The piece 22 includes a step 30 extends peripherally about the door and is for contacting the frame 18 as discussed in more detail hereinafter. The door 16 also has a rearwardly extending wall 32 that is actually integral with the piece 22. The wall 32 extends in a substantially vertical direction and is coupled to a like wall 34 of the frame 18 by means of a conventional piano hinge 36. The line of the hinge is tilted to follow the tilted edges of walls 32 and 34. A plurality of rivets 38 may be used for connecting the piano hinge 36 to walls 32 and 34 as shown in FIG. 3. FIG. 2 also shows these rivets 38 and the piano hinge 36. However other means of attachment such as welding may be used.

The frame 18 has a series of holes along the wall 34 for accommodating fasteners 14 which are used for fastening the whole frame and in turn the door to the wall defining the smoke shaft. The frame 18 also includes a face wall 40 and a step wall 42. It is clear from FIG. 3 that the shape of the piece 22 and the frame 18 are similar and provide steps that are essentially in contact. Actually, there is provided between the step 30 and the step 42 a stainless steel spring-like gasket 44 which is preferably spot welded at point 45 to the frame 18. The gasket 44 is preferably of an L-shape and is preferably bent at an angle greater than 90°. In FIG. 3 the gasket 44 is shown in its compressed position and there is a bias provided by leg 47 of the gasekt 44 against the step 30 of the piece 22. If the door is released the leg 47 provides a spring action that initially urges the door to an open position.

FIG. 3 shows the door in its closed position. This position is maintained by the latching mechanism 20 which is discussed in more detail hereinafter with reference to FIGS. 4 and 5. When the latching mechanism is released the door opens to the position shown in FIG. 2. It is noted that the wall 34 has a tapered edge 35 along which the piano hinge 36 extends. Thus, the door 16 is not hinged in the usual manner on a vertical axis. Thus, when the door is released gravity will cause the door to automatically open to the position shown in FIG. 2 with the door extending into the duct or shaft 10. Further, this opening is assisted by the spring action of the gasket 44 as previously mentioned.

The latch mechanism 20 generally comprises a movable member including latch bolt 50 and a fixed member including latch plate 52, both of which are contained in box 54. A perforated face plate 56 closes the box and the entire box structure is sufficiently open to provide ventilation inside of the box to reduce the likelihood of heat damage.

Figure 4:
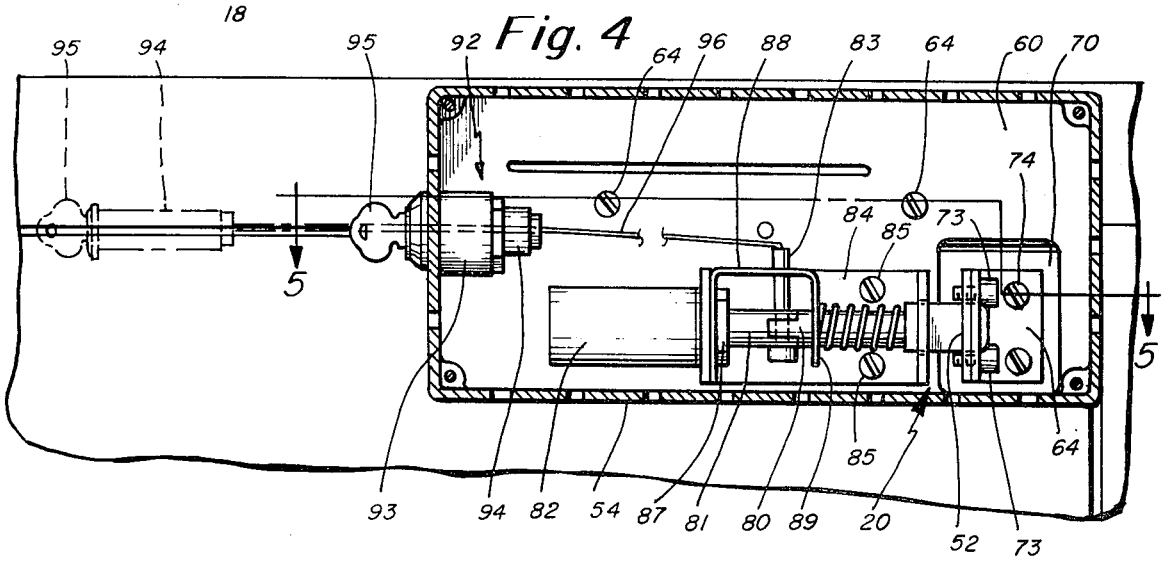
FIG. 4 is a cross sectional view taken along line 4—4 of FIG. 2 showing a detail of the latch means.
Figure 5:
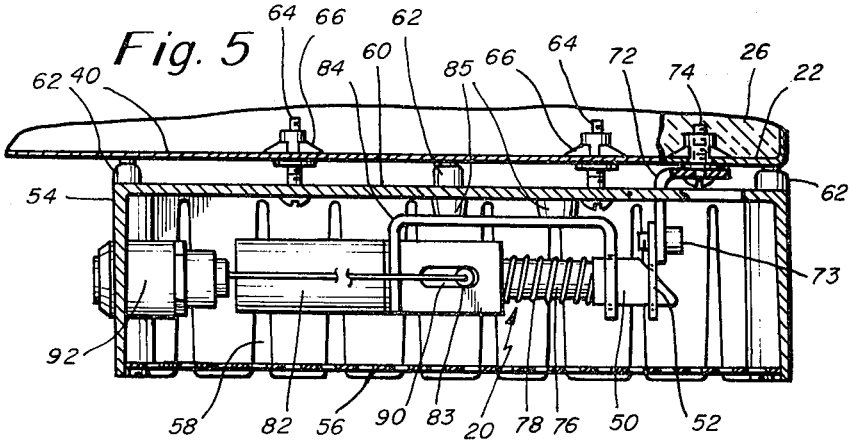
FIG. 5 is a cross sectional view taken along line 5—5 of FIG. 4 with the door in its closed position.

FIG. 5 shows elongated slots 58 in the walls of the box 54. The face plate 56 may be secured to the box by machine screws as shown in FIGS. 4 and 5. The back wall 60 of the box may have a number of bumpers 62 extending therefrom each being disposed intermediate the wall 60 and the face wall 40 of the frame 18. The box is supported from the frame by means of at least two bolts 64 which are received by fixed nuts 66. When the face plate 56 is removed the bolts 64 are exposed and the box can be removed or secured to the frame by rotation of the bolts 64 in the fixed nuts 66 which are fixed to the frame.

The wall 60 of the box has a rectangular opening 70 through which extends the L-shaped bracket 72. One leg of the bracket is for supporting the latch plate 52 by means of bolts 73. The other leg of the bracket 72 is fixed by means of bolts 74 to the front face piece 22 of the door. Thus, when the door is closed as in the position shown in FIG. 5 the bracket 72 supports the catch plate 52 extends into the box 54. The catch plate 52 has an opening for receiving the latch bolt 50 as shown in FIGS. 4 and 5. The latch bolt 50 has a smaller diameter center 76 about which is wound a latch spring 78. The latch bolt 50 also has a keying end 80 which mates with a plunger 81 which extends from the solenoid 82. The plunger and end 80 of the latch bolt are intercoupled by means of an actuating pin 83.

The latch bolt and solenoid 82 are supported from a U-shaped bracket 84 which is secured by bolts 85 to the back wall 60 of the box. Projections may be provided in wall 60 intermediate the bracket 84 and the wall 60 to provide a thread depth for the attachment fasteners 85 for U-bracket 84. A locking nut 87 is provided for securing the solenoid 82 to one end of the bracket 84. This locking nut 87 also secures a second guide bracket 88 which is for guiding the latch bolt 50. Thus, leg 80 of the bracket 88 has an opening for receiving the bolt 50 and for guiding the movement of the bolt in a generally horizontal position as viewed in FIG. 4. The bracket 88 also has a top slot 90 in which the pin 83 is able to move. FIG. 5 shows the pin at one end of the slot 90 with the spring 78 resting against the leg 89 and urging the latch bolt 50 into contact with the catch plate 52.

The vent of this invention can basically be operated in one of two different ways. The vent can be released remotely by operation of the solenoid or pneumatic cylinder 82. When the solenoid or cylinder 82 operates the plunger 81 moves to the left as viewed in FIG. 4, thereby disengaging the latch bolt 50 from the latch plate 52. When this occurs the bias provided by the gasket 44 initially thrusts the door away from its closed position. The tilting of the hinge from a vertical position provides the additional gravitational force for permitting the door to open to its full open position as shown in FIG. 2. The hinge 36 may be tilted at the angle which provides the desired gravitational opening force. For instance an angle of about 2° was used on a representative vent.

Alternatively, the vent unit can be released directly at the unit by means of the key lock assembly 92 which comprises a housing 93, internal tumbler 94, and key 95. A cable 96 extends from the tumbler 94 and connects to the top end of the pin 83. When the key 95 is rotated the tumbler 94 may be then withdrawn such as to the position shown in phantom in FIG. 4 thereby pulling on the cable 96 and in turn releasing the latch bolt 50. The housing 93 is suitably secured in the box 54 by a well known securing mechanism such as a threaded locking nut.

The door 16 may also be provided with a handle or detachable suction cup on its outside surface. After a unit has been released and it is desired to then again secure it in its closed position the handle or suction cup would be useful to hold the door in the closed position until the latching mechanism can be engaged. The suction cup has the advantage of not requiring an unsightly permanent attachment provision on the door. This latching mechanism in accordance with this invention essentially automatically engages once the door is closed by means of the bias provided by spring 78.

It can be seen that one of the important features of the present invention is the provision of a relatively thin metal gasket shown as gasket 44. This gasket is preferably constructed of a stainless steel and is for accommodating fabrication tolerances. This type of a gasket can resist heat on the order of 2000° F or higher. This gasket also provides for minimum leakage so as to insure that the full shaft venting capacity is available to vent a shaft floor.

If one of the units is released and then it is desired to release a unit at a different floor it is necessary that all of the units and in particular their latch mechanisms be resistant to the heat from the shaft so that they can operate even after being disposed to such heat. It is noted that the box carrying the latch mechanism is well ventilated and further that this box is spacedly mounted from the frame to permit sufficient air circulation to reduce the likelihood of damage occasioned by heat from the shaft.

Having described one embodiment of the present invention it should now become apparent to those skilled in the art that other embodiments exist all of which are contemplated as falling within the scope of this invention.

What is claimed is:

1. A vent for venting smoke from a floor of a multistory building and carrying the smoke via a vertical shaft in the building, said vent comprising;

a metallic frame comprising peripheral wall means, means for securing the wall means of the frame in an opening in a wall defining the shaft, said peripheral wall means comprising vertical walls including on one side of the frame at the inner side of the shaft wall an inwardly facing hinge receiving edge, a door dimensioned to fit within the wall means defining the frame, hinge means including one hinge part secured along the hinge receiving edge of the wall means and another hinge part secured to the door for hingedly supporting the door from the frame along a nonvertical axis so that the door is permitted to swing open by gravity into the shaft, and latch means including latch parts carried by the door and frame, respectively, and means disposed outwardly of the door and frame for releasing the latch parts to permit the door to open.

2. A vent as set forth in claim 1 including a metal gasket secured to one of said frame or door and disposed between the frame and door.

3. A vent as set forth in claim 2 wherein said metal gasket includes an L-shaped cross-section having one leg secured to the frame and the other leg disposed for contact between the frame and door.

4. A vent as set forth in claim 3 wherein the metal gasket is constructed of a thin stainless steel and is bent with its legs normally at an angle greater than 90°.

5. A vent as set forth in claim 3 wherein the frame and door each include a step defining facing walls that have the gasket therebetween.

6. A vent as set forth in claim 1 wherein said latch parts include a latch bolt, means for supporting the latch bolt and a latch plate secured to the door.

7. A vent as set forth in claim 6 including a box having a plurality of holes therein and means for spacedly supporting the box from the frame, said box for housing at least the latch bolt and including an opening for receiving the latch plate when the door is closed.

8. A vent as set forth in claim 7 including means for biasing the latch bolt toward the latch plate, and means for releasing the latch means by moving the latch bolt away from the latch plate.

9. A vent as set forth in claim 8 wherein the means for releasing includes an electrical or pneumatic means and a mechanical means.

10. A vent for venting smoke from a floor of a multistory building and carrying the smoke via a vertical shaft in the building, said vent comprising;

a frame comprised of peripheral wall means, means for securing the frame in an opening in the shaft, a door dimensioned to fit within the frame, means for supporting the door from the frame so that the door can be hinged opened and closed, latch means carried by at least the door for holding the door closed, said frame having associated therewith stop means for limiting the closed position of the door relative to the frame, gasket means comprising a flexible metallic gasket having one end secured to one of said door and frame and another free end deflectably engageable by the other of said door and frame, and means for releasing the latch means to open the door.

11. A vent as set forth in claim 1 wherein said hinge means comprises an elongated one-piece hinge.

12. A vent as set forth in claim 1 wherein said frame has a depth on the order of the thickness of the wall defining the stack.

13. A vent as set forth in claim 1 wherein said frame has associated therewith stop means for limiting the closed position of the door relative to the frame.

14. A vent as set forth in claim 13 including gasket means comprising a flexible metallic gasket secured between the stop means and door.

15. A vent as set forth in claim 14 wherein said stop means comprises an integral step of the frame, said door having a like step with the gasket disposed between the facing step surfaces of door and frame.

16. A vent as set forth in claim 14 wherein said metallic gasket has an end secured to the frame and a free end deflectably engageable by the door.

17. A vent as set forth in claim 10 wherein said stop means comprises an integral step of the frame, said door having a like step with the metallic gasket disposed between the facing steps of the door and frame.

18. A vent as set forth in claim 10 wherein said metallic gasket extends peripherally about the entire frame and has an end secured to the frame and a free end deflectably engageable by the door.

19. A vent as set forth in claim 18 wherein said metallic gasket has an L-shaped cross-section having the fixed leg secured to the frame and the free end extending away from the door but contacting a peripheral section of the door.

20. A vent for venting smoke from a floor of a multistory building and carrying the smoke via a vertical shaft in the building, the vent comprising;

a metallic frame comprising peripheral wall means, means for securing the wall means of the frame in an opening in a wall defining the shaft, said peripheral wall means including on one side of the frame at the inner side of the shaft wall, an inwardly facing hinge receiving edge, a door comprised of a metallic shell and a fire resistant core and dimensioned to fit within the wall means defining the frame, hinge means including one hinge part secured along the hinge receiving edge of the wall means and another hinge part secured to the door for hingedly supporting the door from the frame, gasket means comprising a relatively thin flexible metallic gasket disposed between the door and frame and having a free end engageable with the door for urging the door to an open position, latch means including latch parts carried by the door and frame respectively, release means for releasing one of the latch parts to permit the door to open, and housing means for the releasing means and including means for spacedly supporting the housing means from the outer surface of the frame.

21. A vent as set forth in claim 20 wherein the housing for the releasing means comprises a box having a plurality of holes therein for permitting air circulation inside of the box.

22. A vent as set forth in claim 1 wherein said hinge receiving edge also extends along a non-vertical axis coincident with the axis of the hinge means.

* * * * *